United States Patent [19]

Marshall

[11] 4,029,281

[45] June 14, 1977

[54] RECEPTACLE MOUNTING BRACKET

[76] Inventor: John A. Marshall, 416 Devonshire Lane, Bolingbrook, Ill. 60439

[22] Filed: July 19, 1976

[21] Appl. No.: 706,172

[52] U.S. Cl. ..... 248/220.3; 211/88; 248/311.1

[51] Int. Cl.[2] ..... A47G 23/02; A47B 3/00; A47F 5/00

[58] Field of Search ..... 248/311.1, 313, 223, 248/224, 225, 220.5, DIG. 3, 359, 360; 211/88, 71

[56] References Cited

UNITED STATES PATENTS

| | | | |
|---|---|---|---|
| 1,170,414 | 2/1916 | Christensen | 248/311.1 X |
| 1,203,942 | 11/1916 | Walker | 248/311.1 |
| 2,252,260 | 8/1941 | Jones | 248/311.1 |
| 3,094,892 | 6/1963 | Topf | 248/DIG. 3 |

FOREIGN PATENTS OR APPLICATIONS

| | | | |
|---|---|---|---|
| 651,467 | 1/1964 | Belgium | 248/311.1 |

*Primary Examiner*—J. Franklin Foss

[57] ABSTRACT

A bracket for mounting of a receptacle is provided with retaining means adapted to be detachably secured to the rim of the receptacle and to the support surface so as to maintain the top of the receptacle in a relatively fixed position. Supporting means adapted to be suspended from the retaining means for engagement with the bottom end and side of the receptacle is also provided with elastic means interconnecting the retaining means and the supporting means to provide axial restraint therebetween for supporting the receptacle in a relatively fixed position and permitting removal of the receptacle from the bracket by stretching the elastic means to permit release therefrom.

8 Claims, 6 Drawing Figures

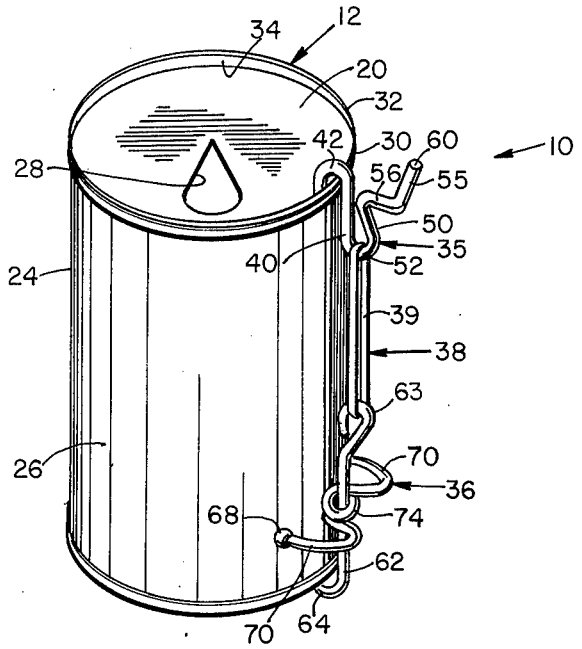
Fig. 1
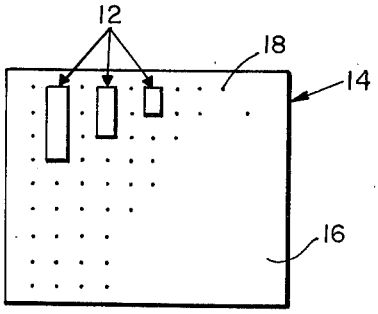
Fig. 2
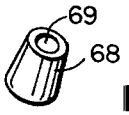
Fig. 5
Fig. 4
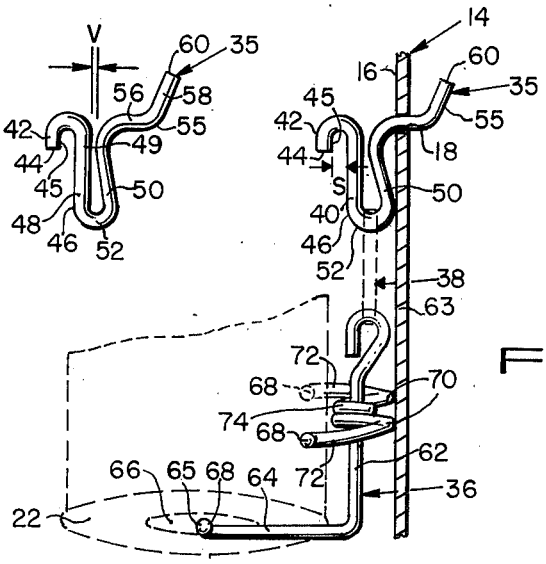
Fig. 3
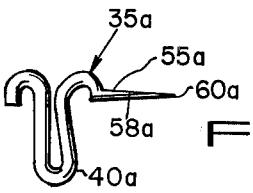
Fig. 6

RECEPTACLE MOUNTING BRACKET

BACKGROUND OF THE INVENTION

The present invention relates to brackets for retaining receptacles, and is particularly suitable for the mounting of receptacles for display purposes.

There are many instances where collectors of receptacles such as cans wish to display on a support surface a variety of cans that they have collected. These cans may be empty and vary slightly in axial length and diameter. The present inventor has developed a new and novel mounting bracket that is universal in that it can accommodate cans, as well as other receptacles, having various axial lengths.

OBJECTS OF THE INVENTION

An object of the present invention is to provide a universal mounting bracket to accommodate receptacles that may vary in length and be mounted for display purposes.

Another object of the present invention is to provide a mounting bracket that is easily retained on a support surface and permits the receptacle to be easily and quickly attached and detached with respect to the bracket.

Another object is to provide a holder for the purposes stated which is simple and inexpensive to produce and simple to use, the construction being such as to ensure maximum durability, safety, and convenience of usage.

Other objects and advantages of the present invention will become apparent as the disclosure proceeds.

SUMMARY OF THE INVENTION

A bracket is disclosed for mounting a receptacle to a support surface, the receptacle may be of the type having a rim portion extending above the top at one end thereof and a bottom at the other end. The bracket includes retaining means adapted to be detachably secured to the rim of the receptacle and to the support surface so as to maintain the top of the receptacle in a relatively fixed position. Supporting means is utilized in conjunction with the retaining means and is adapted to be suspended from the retaining means for engagement with the bottom and side wall of the receptacle.

Elastic means connects the retaining means and the supporting means to provide axial restraint therebetween for supporting the receptacle in a relatively fixed position and permitting removal of the receptacle from the bracket by stretching the elastic means to permit release therefrom.

The retaining means includes a body portion for engagement with the side wall of the receptacle with a hook extending from the body portion in spaced relation thereto to engage the rim interiorly of the receptacle, and a gripping member extending outwardly from the body portion in substantially the opposite direction to the hook for securement of the retaining means to the support surface.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part thereof, wherein like reference numerals refer to like parts throughout the several views and in which:

FIG. 1 is a perspective view of the mounting bracket in accordance with the present invention secured to a receptacle;

FIG. 2 is a front view illustrating a variety of receptacles that may be positioned on a support surface in accordance with the present invention;

FIG. 3 is a side elevational view of the mounting bracket, showing its application to a receptacle represented by broken lines;

FIG. 4 is a side elevational view of one form of retaining member in accordance with the present invention;

FIG. 5 is a perspective view of a gripping member that may be utilized; and

FIG. 6 is a side elevational view of another form of gripping member in accordance with the present invention.

DETAILED DESCRIPTION OF THE DRAWINGS

Referring now to the drawings, and particularly FIGS. 1–5 thereof, there is illustrated a universal mounting bracket 10 for mounting a can or other receptacle 12 in fixed relation to support means 14 having a support surface 16 with a plurality of openings or apertures 18 extending therethrough. The receptacle 12 may be of the type having a top 20 at one end thereof with a spaced apart bottom 22 at the other end thereof and a vertically extending side wall 24 having an outer surface 26 which normally contains the various information about the receptacle 12 that one desires to display. The receptacle 12 is illustrated of the type having an opening 28 on the top 20 as is normally provided on a quick opening type can. The receptacle 12 includes a rim 30 having an upper end 32 peripherally extending around the receptacle 12 and an inner lip 34 that terminates at the top 20 of the receptacle 12.

The invention essentially includes retaining means 35 adapted to be detachably secured to the rim 30 of the receptacle 12 and to the support means 14 so as to maintain the top 20 of the receptacle 12 in a relatively fixed position. Supporting means 36 is provided and adapted to be suspended from the retaining means 35 for engagement with the bottom 22 and side wall 24 of the receptacle 12. In conjunction with the retaining means 35 and supporting means 36 is elastic means 38 adapted for connecting said retaining means 35 and the supporting means 36 together to provide axial restraint therebetween for supporting the receptacle 12 in a relatively fixed position and permitting removal of the receptacle from the bracket 10 by stretching the elastic means 38 to permit release of the receptacle 12 therefrom. In similar fashion, the elastic means 38, which may be in the form of a rubberband 39, or other elastic element, is also stretched to permit the initial positionment of the receptacle 12 in the position illustrated in FIG. 1.

In use of the bracket 10 the retationship to retain the receptacle 12 as illustrated in FIG. 1 may first be accomplished before mounting of the retaining means 35 relative to the support means 14 as illustrated in FIGS. 2 and 3. As illustrated in FIG. 2, a plurality of receptacle 12 of various lengths may be utilized to display a variety of receptacles having various lengths. The simplicity of the invention by providing the elastic means 39 to both expand and provide a compressive force permits the flexibility of the invention for its intended use.

The retaining means 35 may include a body portion 40 for engagement with the side wall 24 at its outer surface 26 as seen in FIG. 1. The body portion 40 may be integrally formed with a hook 42 having a downwardly projecting terminal end 44 and defining an inner lip 45 adapted to overhang the upper end 32 of the rim 30 and extend interiorly in abutting relation with the inner surface 34 of the rim 30. The spacing S between the lip 45 and forward edge 46 of the body portion 40 is selected to accommodate conventional size receptacles 12. The retaining means 35 illustrated in FIG. 4 is shown in mounted relation in FIG. 3 and may be formed of wire of a desired size.

The body portion 40 includes a first element or shank portion 48 integrally formed with the hook 42 and a second shank portion 50 integrally formed with the first shank portion 48 and joined together at one end thereof at a loop 52 with a vertical channel 49 extending therebetween, and defined by the dimension V. In this manner, the loop 52 is adapted to retain one end of the elastic means 38 in fixed relation thereto. The spacing V between the first shank portion 48 and the second shank portion 50 permits the elastic means 38 to extend therethrough for positionment on the loop 52. The elastic member 39 may be initially stretched so that it becomes temporarily thinner to be squeezed through the spacing defined by the dimension V.

The retaining means 35 further includes a gripping member 55 extending outwardly from the second shank portion 50 and adapted to extend through the aperture 18 in the support means 14. The gripping member 55 extends in substantially the same plane but in the opposite direction than the hook 42 to obtain the necessary securement to the support means 14 such that the loop portion 52 may abut the support surface 16.

The gripping member 55 is provided with an outwardly extending neck portion 56 integrally formed with the body portion 40 and in upwardly extending head portion 58 integrally formed with the neck portion 56 having a distal end 60 that is inserted through the opening 18 to extend therethrough as seen in FIG. 3.

The support means 36 includes a vertically extending support member 62 having a curved or hooked portion 63 at one end thereof, which is preferably dimensioned to have a minimal spacing from the support surface 16, for retaining the elastic means 38 in fixed relation thereto as illustrated in FIGS. 1 and 3. A leg portion 64 may be integrally formed at substantially the opposite end of the support member 62 for engagement with the bottom 22 of the receptacle 12 The leg portion 64 extends outwardly from the support member 62 and may be positioned at its front end 65 in an aperture or opening 66 provided by the user on the bottom 22 of the can 12.

Positioned on the front end 65 may be a gripping member 68 as illustrated in FIG. 5 and made of a relatively soft material to prevent scratching of any surface of the receptacle 12, or contained within the opening 66. The gripping member 68 has a recess 69 therein to be received on the leg portion 64. To retain the receptacle 12 in position a pair of arms 70 extend outwardly from the support member 62 and at the terminal end 72 of each arm 70 there may be provided a gripping member 68 for engagement with the outer surface 26 of the side wall 24. The arm 70 may be formed by a telescoping connecting section 74 that is wound in a spiral fashion around the vertically extending support member 62 such that it is in fixed relation thereto and may be vertically adjusted by the user if so desired.

FIG. 6 illustrates an alternate embodiment of the retaining means **35*a* in which the body portion 40*a* is modificed in that the gripping member 55*a* terminates in a pointed end 60*a* that is adapted to be forced into an opening on the support means. This permits the pointed head portion 58*a*** to be used in various size openings or even on a wall in which there are no openings.

What has been above illustrated is a novel bracket that may be simply constructed of wire or rod stock or may even be molded out of plastic to obtain low manufacturing cost. The device may be applied to receptacles of various sizes and capacities, without alteration.

Although an illustrative embodiment of the invention has been described in detail herein with reference to the accompanying drawings, it is to be understood that the invention is not limited to the precise embodiment, and that various changes and modifications may be effected therein without departing from the scope or spirit of the invention.

What is claimed is:

1. A bracket for mounting a receptacle to a support surface, the receptacle having a rim portion extending above the top at one end thereof and a bottom at the other end comprising:

a. retaining means adapted to be detachably secured to the rim of the receptacle and to the support surface so as to maintain the top of the receptacle in a relatively fixed position b. supporting means adapted to be suspended from said retaining means for engagement with the bottom and the side wall of the receptacle; and c. elastic means for connecting said retaining means and said supporting means to provide axial restraint therebetween for supporting the receptacle in a relatively fixed position and permitting removal of the receptacle from the bracket by stretching said elastic means to permit release therefrom;

d. said retaining means includes:

1. a body portion for engagement with the rim or side wall of the receptacle;
2. a hook extending from said body portion in spaced relation thereto to engage the rim interiorly of the receptacle; and
3. a gripping member extending outwardly from said body portion in substantially the opposite direction to said hook for securement of said retaining means to the support surface;

e. said body portion includes:

1. a first shank portion integrally formed with said hook; and
2. a second shank portion integrally formed with said gripping member and joined together with said first shank portion thereof at a loop with a vertical spacing therebetween, said loop adapted to retain said elastic means in fixed relation thereto.

2. A bracket as defined in claim 1, wherein said spacing between said first and said second shank portions permits said elastic means to extend therethrough for positionment on said loop.

3. A bracket as defined in claim 1, wherein said gripping member includes:

a. an outwardly extending neck portion integrally formed with said body portion; and b. an upwardly extending head portion integrally formed with said neck portion to extend through an opening in the support surface and on the opposite side thereof.

4. A bracket as defined in claim 1, wherein said gripping member includes:

a. an outwardly extending neck portion integrally formed with said body portion; and b. an outwardly extending pointed head portion integrally formed with said neck portion to extend through an opening in the support surface to maintain said retaining means in relatively fixed positions with respect thereto.

5. A bracket as defined in claim 1, wherein said supporting means includes:

a. a vertically extending support member;

b. a hooked portion formed at substantially one end of said support member for retaining said elastic means;

c. a leg portion formed at substantially the opposite end of said support member for engagement with the bottom of the receptacle; and d. a pair of arms connected to said support member and extending outwardly therefrom for engagement with the side wall of the receptacle.

6. A bracket as defined in claim 5, and further including gripping members secured to the free end of each of said arm, said gripping members being of a relatively soft material to prevent scratching the surface of the receptacle.

7. A bracket for mounting a receptacle to a support surface, the receptacle having a rim portion extending above the top at one end thereof and a bottom at the other end comprising:

a. retaining means adapted to be detachably secured to the rim of the receptacle and to the support surface so as to maintain the top of the receptacle in a relatively fixed position;

b. supporting means adapted to be suspended from said retaining means for engagement with the bottom and the side wall of the receptacle; and c. elastic means for connecting said retaining means and said supporting means to provide axial restraint therebetween for supporting the receptacle in a relatively fixed position and permitting removal of the receptacle from the bracket by stretching said elastic means to permit release therefrom;

d. said retaining means includes:

1. a body portion for engagement with the rim or side wall of the receptacle;

2. a hook extending from said body portion in spaced relation thereto to engage the tim interiorly of the receptacle; and 3. a gripping member extending outwardly from said body portion in substantially the opposite direction to said hook for securement of said retaining means to the support surface, wherein said body portion includes;

4. a first shank portion integrally formed with said hook; and 5. a second shank portion integrally formed with said gripping member and joined together with said first shank portion thereof at loop with a vertical spacing therebetween, said loop adapted to retain said elastic means in fixed relation thereto, wherein said supporting means includes;

6. a vertically extending support member;

7. a hooked portion formed at substantially one end of said support member for retaining said elastic means;

8. a leg portion formed at substantially the opposite end of said support member for engagement with the bottom of the receptacle; and 9. a pair of arms connected to said support member and extending outwardly therefrom for engagement with the side wall of the receptacle.

8. A bracket as defined in claim 7, wherein said spacing between said first and said second shank portions permits said elastic means to extend therethrough for positionment on said loop.

* * * * *